United States Patent [19]

Nakauchi

[11] Patent Number: 4,686,351

[45] Date of Patent: Aug. 11, 1987

[54] THERMAL DEVELOPING APPARATUS

[75] Inventor: Kenji Nakauchi, Kanagawa, Japan

[73] Assignee: Fuji Photo Film Co., Ltd., Kanagawa, Japan

[21] Appl. No.: 808,980

[22] Filed: Dec. 16, 1985

[30] Foreign Application Priority Data

Jan. 7, 1985 [JP] Japan ..... 60-000697

[51] Int. Cl.[4] ..... H05B 1/02

[52] U.S. Cl. ..... 219/216; 355/3 FU; 219/388; 219/494

[58] Field of Search ..... 219/388, 216, 494, 497, 219/499, 501; 355/3 FU, 14 FU

[56] References Cited

U.S. PATENT DOCUMENTS

| | | | |
|---|---|---|---|
| 3,532,855 | 10/1970 | Van Cleave | 219/216 |
| 3,588,445 | 6/1971 | Hopkins | 219/216 |
| 3,795,787 | 3/1974 | Nogaito | 219/216 |
| 3,878,358 | 4/1975 | Barton | 219/216 |
| 4,194,826 | 3/1980 | Lewis | 219/216 |
| 4,484,294 | 11/1984 | Rosenberg | 219/388 |

FOREIGN PATENT DOCUMENTS

| | | | |
|---|---|---|---|
| 56-154746 | 11/1981 | Japan | 355/14 FU |

*Primary Examiner*—E. A. Goldberg
*Assistant Examiner*—Teresa J. Walberg
*Attorney, Agent, or Firm*—Sughrue, Mion, Zinn, Macpeak & Seas

[57] ABSTRACT

A thermal developing apparatus develops a thermally developable photosensitive material having an electrically conductive, heat-generating layer. The temperature of the photosensitive material is raised to a predetermined temperature suitable for development by supplying the heat-generating layer with the electric energy corrected in accordance with the temperature of the air surrounding the photosensitive material.

20 Claims, 8 Drawing Figures

THERMAL DEVELOPING APPARATUS

BACKGROUND OF THE INVENTION

1. Field of the Invention

The present invention relates to an apparatus for thermally developing a thermally developable photosensitive material. More particularly, the present invention pertains to a thermal developing apparatus for use in thermally developing an image recorded by exposure on a photosensitive material.

2. Description of the Related Art

A typical thermally developable photosensitive material (hereinafter referred to simply as a "photosensitive material") has a photosensitive layer and an electrically conductive, heat-generating layer. An image recorded on the photosensitive layer by exposure is developed by heating the photosensitive layer by means of the Joule heat generated by supplying a heating current through the electrically conductive, heat-generating layer. To obtain a desired degree of development of the image with respect to this type of photosensitive material, it is necessary to supply a heating current of a predetermined magnitude therethrough for a predetermined period of time on the basis of time-temperature data given by the manufacturer of the photosensitive material concerned.

An apparatus for heating the above-described type of photosensitive material has already been proposed wherein the heating temperature is accurately controlled by measuring the resistance value of the electrically conductive, heat-generating layer formed on the photosensitive material, utilizing the fact that this resistance value varies depending upon the temperature of the photosensitive material (see U.S. patent application Ser. No. 48,483).

However, the temperature-resistance characteristic differs depending upon the material employed for the electrically conductive, heat-generating layer, and it is therefore impossible to effect an appropriate correction with respect to a photosensitive material having an electrically conductive, heat-generating layer formed of a material other than a specific one. Further, even when a constant electric power is supplied to the electrically conductive, heat-generating layer, the temperature of the photosensitive material varies with changes in the ambient air temperature, which makes it impossible to effect an accurate temperature control.

SUMMARY OF THE INVENTION

In view of the above circumstances, it is an object of the present invention to provide a thermal developing apparatus capable of controlling the temperature of a photosensitive material to an optimum temperature for development even when the ambient air temperature changes It is another object of the present invention to provide a thermal developing apparatus capable of controlling the temperature of a photosensitive material to an optimum temperature for development even when there are changes in both the ambient air temperature and the heat radiated from the photosensitive material and reflected from a heat reflecting plate.

It is still another object of the present invention to provide a thermal developing apparatus capable of controlling the temperature of a photosensitive material to an optimum temperature for development even when there is a change in terms of the material employed for the photosensitive material.

To these ends, the present invention provides a thermal developing apparatus which thermally develops a photosensitive material having an electrically conductive, heat-generating layer, comprising: temperature sensor means for detecting the temperature of the air surrounding the photosensitive material; calculating means for calculating the electric energy required for raising the temperature of the photosensitive material from a temperature corresponding to the detected air temperature to a predetermined temperature suitable for development; and supply means for supplying the electrically conductive, heat-generating layer with an electric energy on the basis of the result of calculation carried out by the calculating means.

According to another aspect of the present invention, the above thermal developing apparatus is provided with: reflecting means for reflecting the heat radiated from the photosensitive material; temperature sensor means for detecting the temperature of the reflecting means; temperature sensor means for detecting the temperature of the air surrounding the photosensitive material; calculating means for calculating the electric energy required for raising the temperature of the photosensitive material to a predetermined temperature suitable for development on the basis of both the temperature of the reflecting means and the ambient air temperature; and supply means for supplying the electrically conductive, heat-generating layer with an appropriate electric energy on the basis of the result of calculation carried out by the calculating means.

The above-described electric energy may be calculated by any of the following methods: electric energy is calculated on the assumption that the period of time during which heating electric power is to be supplied is fixed; the heating time is calculated on the assumption that the electric power which is to be supplied is fixed; or both the period of time during which the heating electric power is to be supplied and the electric power which is to be supplied are calculated. When there is a change in terms of the type of material of which the photosensitive material is composed, electric energy required in that case is calculated in the manner described above in consideration of the heat capacity of the photosensitive material employed.

Thus, according to the present invention, the ambient air temperature ta is measured by the temperature sensor means before the photosensitive material is heated. The temperature tc of the heat reflected from the reflecting means may also be measured in order to effect a more appropriate thermal development. Next, the calculating means calculates the electric energy required for raising the temperature of the photosensitive material from a temperature corresponding to the measured air temperature to a predetermined temperature suitable for development. The smaller the values of ta and tc, the longer the time required for the temperature of the photosensitive material to rise in the initial stage of heating, and the larger the electric energy which needs to be supplied. Further, the smaller the values of ta and tc, the larger the amount of heat radiated from the photosensitive material, and the larger the electric energy which needs to be supplied. However, the effect of the temperature tc is relatively small.

Next, the electric energy corresponding to the calculated value is supplied to the electrically conductive, heat-generating layer by the supply means.

By virtue of the above arrangement of the present invention, it is possible to thermally develop a photosensitive material at a constant temperature irrespective of the material employed for the electrically conductive, heat-generating layer formed on the reverse surface of the photosensitive material and of the ambient air temperature. In addition, even when a change in the ambient air temperature causes a change in the period of time required for the temperature of the photosensitive material to rise in the initial stage of heating, it is possible to effect thermal development accurately for an appropriate period of time.

BRIEF DESCRIPTION OF THE DRAWINGS

FIG. 4(*b*) is a graph showing the relationship between the heating time and the heating electric power in the second embodiment.

DESCRIPTION OF THE PREFERRED EMBODIMENTS

Preferred embodiments of the thermal developing apparatus according to the present invention will be described below with reference to the accompanying drawings.

Figure 1A:
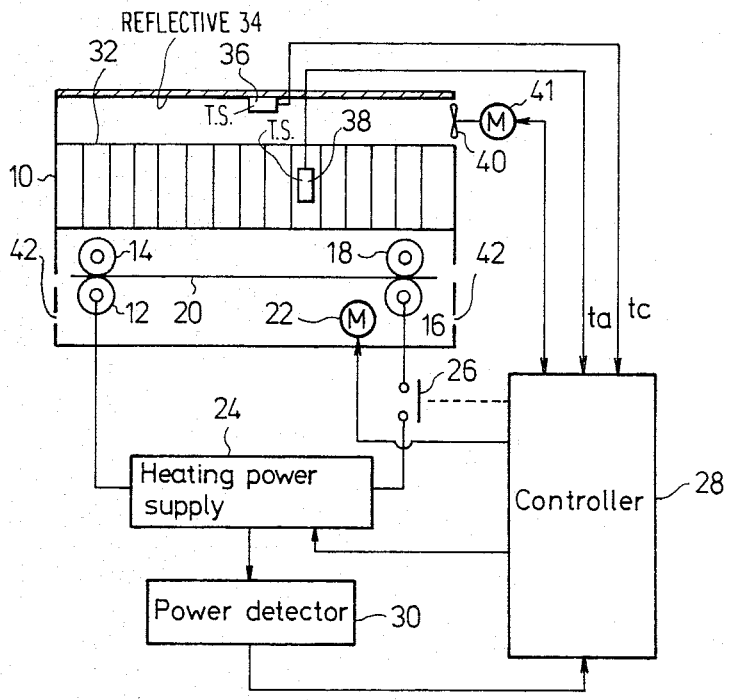
FIG. 1A schematically shows one embodiment of the thermal developing apparatus according to the present invention.

Referring first to FIG. 1A, pairs of driving rollers and press rollers 12, 14 and 16, 18 are disposed within a casing 10 for transporting a photosensitive material 20 by clamping the same therebetween. The driving roller 16 is rotated by a motor 22, while the driving roller 12 is rotated in unison with the driving roller 16 through a chain (not shown).

Figure 1B:
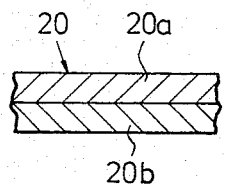
FIG. 1B is a sectional view of a photosensitive material.

As shown in FIG. 1B, a photosensitive layer 20*a* is formed on the surface of the photosensitive material 20, and an electrically conductive, heat-generating layer 20*b* is formed on the reverse surface of the photosensitive material 20. The driving roller 12 is formed of an electrically conductive metal and is pressed against the heat-generating layer 20*b*. The press roller 14 is constituted by a heat-resistant rubber roller and resiliently contacts the photosensitive layer 20*a*. A heating power supply 24 (H.P.S.) is connected between the driving rollers 12 and 16 through slip rings (not shown), whereby electric power is supplied to the electrically conductive, heat-generating layer 20*b* of the photosensitive material 20 from the heating power supply 24 through the slip rings. A make contact 26 is provided in the wiring between the power supply 24 and the driving roller 16, the make contact 26 being opened and closed by the operation of a relay coil provided in a controller 28.

The output voltage and current signals from the heating power supply 24 are supplied to a power detector 30 (P.D.) which obtains the product of these signals to detect the value of electric power applied to the heat-generating layer 20*b* and supplies the detected value to the controller 28. The controller 28 controls the voltage of the heating power supply 24 so that the value of electric power coincides with a predetermined value P.

An air flow-settling plate 32 with a honeycomb-type structure is disposed above the photosensitive material 20 so as to prevent the temperature of the photosensitive material 20 from becoming non-uniform due to the convection of the air within the casing 10. A heat-reflecting plate 34 is provided on the inner side of the upper surface of the casing 10 so as to reflect the heat radiated from the photosensitive material 20. A temperature sensor 36 (T.S.) is mounted on the heat-reflecting plate 34 to detect a signal representing the temperature tc of the heat-reflecting plate 34, the signal being input to the controller 28. A temperature sensor 38 (T.S.) for detecting the temperature ta of the air within the casing 10 is disposed inside the air flow-settling plate 32. The signal representing the temperature ta is also input to the controller 28. The controller 28 calculates a heating time T from the respective values of the temperatures ta and tc and closes the make contact 26 for the calculated time T. The controller 28 further calculates the electric power P applied to the electrically conductive, heat-generating layer 20*b* and controls the voltage of the heating power supply 24 on the basis of the calculated power P.

A fan 40 which is rotated by a motor 41 is disposed on the side wall of the upper portion of the casing 10. The fan 40 is turned ON by the controller 28 so as to expel the air from inside the casing 10 to the outside and to cause fresh air to flow into the casing 10 through vent holes 42. This ventilation is carried out in order that the temperature of air inside the casing 10 and the temperature of the heat-reflecting plate 34, which have risen as a result of the previous thermal developing operation are lowered near the outside air temperature, and the heating time T and heating power P for a subsequent thermal developing operation is thereby accurately calculated.

Figure 1C:
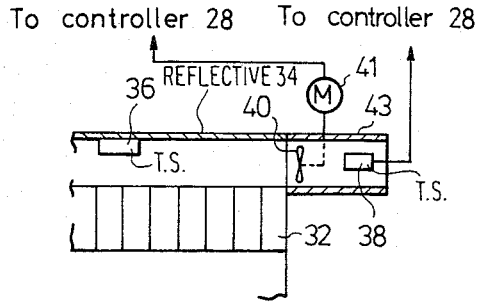
FIG. 1C is a sectional view of a casing provided with a duct.

As shown in FIG. 1C, a duct 43 may be provided on the casing 10 so as to project from the portion thereof at which the fan 40 is mounted in order to expel the air from inside the casing 10 through the duct 43, and the temperature sensor 38 may be mounted within the duct 43. In this case, it is possible for the temperature sensor 38 to detect the air temperature inside the casing 10 more accurately.

Figure 1D:
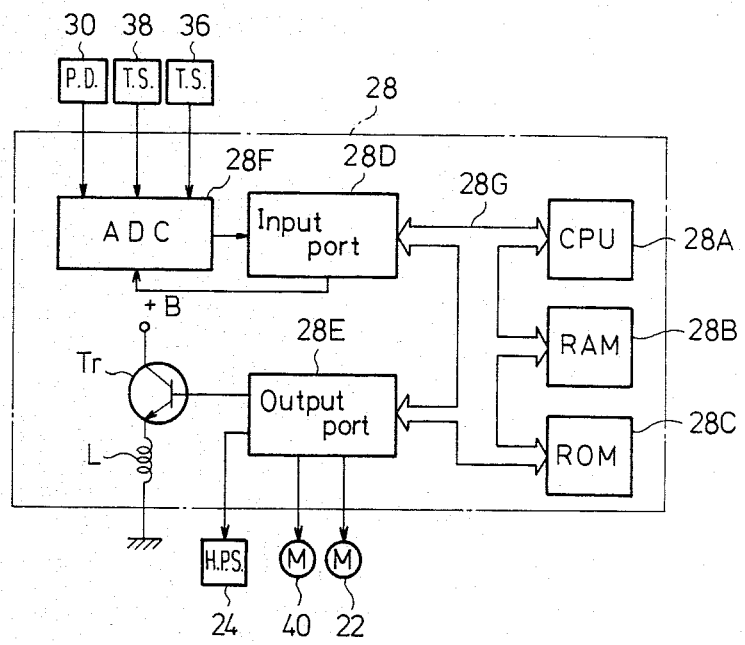
FIG. 1D is a detailed block diagram of a controller for controlling the thermal developing apparatus shown in FIG. 1A.

The controller 28 is, as shown in FIG. 1D, constituted by a microcomputer which includes a CPU 28A, a RAM 28B, a ROM 28C, an input port 28D, an output port 28E, an analog-to-digital converter (hereinafter referred to as an "ADC") 28F with a multiplexer function, and a bus 28G which interconnects these members. To the ADC 28F are connected the temperature sensors 36, 38 and the power detector 30. The ADC 28F selects any one of the signals input thereto in response to the instruction from the CPU 28A and successively converts detected signals into digital signals. The output port 28E is connected to the base of a transistor Tr which has the collector connected to a power supply and the emitter connected with an exciting coil L. Accordingly, when a high-level signal is input to the base of the transistor Tr from the output port 28E, the transistor Tr is turned ON to energize the exciting coil L, thus closing the make contact 26. Further, the motors 22, 41 and the heating power supply 24 are connected to the output port 28E.

The heating time T and the heating power P will next be described.

The heating time T and heating power P required for heating a photosensitive material from its present temperature to a predetermined temperature may be represented as follows:

$$T=T_0+\Delta T \quad (1)$$

$$P=P_0+\Delta P \quad (2)$$

where $T_0$, $P_0$ respectively represent values required for the ambient air temperature ta and the temperature tc of the reflecting plate 34 to rise to the above predetermined temperature from reference values (e.g., 20° C. and 20° C., respectively), while ΔT, ΔP respectively represent correction values for correcting changes in the temperature of the photosensitive material.

Considering the heat quantity (the heat capacity of the photosensitive material × s a temperature rise Δt) in relation to the photosensitive material, the quantity of heat applied to the photosensitive material is a total of the Joule heat produced by the heating current and the heat radiated from the heat-reflecting plate 34, while the quantity of heat which the photosensitive material loses is a total of the radiant heat released into the air, the conduction heat conducted to the air, and the evaporation heat released from the photosensitive material by the evaporation of the water contained in the photosensitive material. The heat quantity is therefore expressed by the following formula (3):

The heat capacity of the photosensitive material × a temperature rise Δt = the Joule heat produced by input electric power + input radiant heat − (radiant heat + conduction heat + evaporation heat) . . . (3)

As the temperature tc of the reflecting plate 34 changes, the input radiant energy (input radiant heat) and the radiant energy (radiant heat) change, while a change in the ambient air temperature ta causes a change in the thermal energy conducted to the air (conduction heat). Since the energy radiated from the photosensitive material and the input radiant energy to the photosensitive material are sufficiently small as compared with the input electric power supplied to the photosensitive material, the degree to which the temperature rise Δt depends on the temperature tc of the reflecting plate 34 is relatively small. It is to be noted that the heat quantity of the photosensitive material is the product of the specific heat and mass of the photosensitive material and therefore depends on the mass, that is, thickness and the like, of the photosensitive material, while the evaporation heat depends on the quantity of water contained in the photosensitive material. Further, the initial temperature of the photosensitive material may be considered to be equal to the ambient air temperature ta.

Accordingly, variations in dynamic ambient air temperature and input radiant energy are corrected by the heating time correction value ΔT on the basis of changes in initial temperature of the photosensitive material, and variations in conduction energy and radiant energy are corrected by the heating power correction value ΔP. In this case, ΔT and ΔP may be expressed as follows:

$$\Delta T=f_1(ta)+f_2(ta-tc)+f_3(tc) \quad (4)$$

$$\Delta P=f_4(ta)+f_5(tc) \quad (5)$$

For example, the functions $f_1$ to $f_5$ are considered to be linear expressions, and ΔT and ΔP are expressed as follows:

$$\Delta T=K_1ta+K_2(ta-tc)+K_3tc+K_4 \quad (6)$$

$$\Delta P=K_5ta+K_6tc+K_7 \quad (7)$$

Then, constants $K_1$ to $K_7$ are experimentally obtained for each given range of ta and tc to prepare a constant table, which is then stored in the ROM 28C within the controller 28.

It is to be noted that since the degree to which ΔT and ΔP depend on tc is sufficiently small, the terms including tc may be ignored when the formulae (4) and (5) are calculated to obtain ΔT and ΔP, which are then stored in the ROM 28C, as follows:

$$\Delta T=f'_1(ta) \quad (4')$$

$$\Delta P=f'_2(ta) \quad (5')$$

Figure 2:
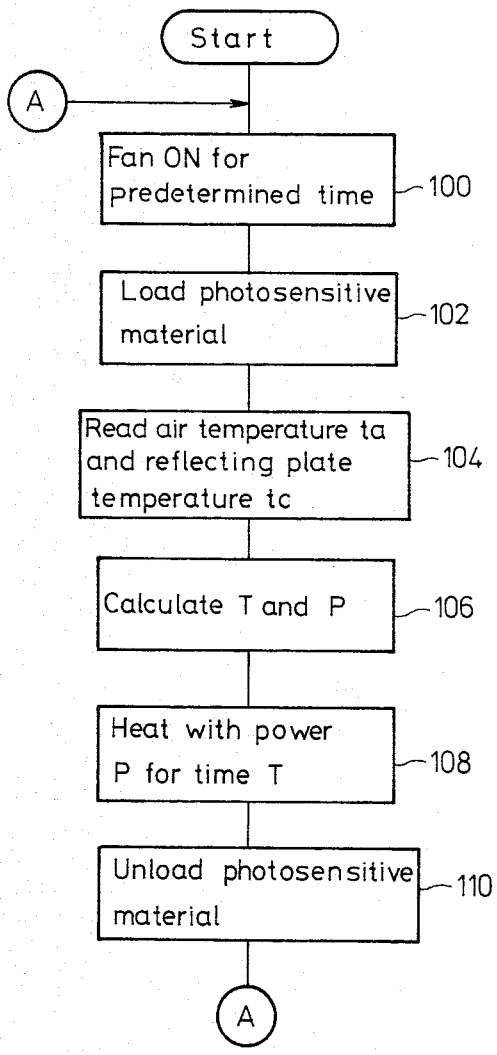
FIG. 2 is a flow chart schematically showing the flow of control carried out by the controller shown in FIG. 1A.

The operation of the embodiment arranged as detailed above will be described below with reference to the flow chart shown in FIG. 2.

In Step 100, the fan 40 is turned ON for a predetermined period of time so that the outside air flows into the casing 10 in order to make the temperature inside the casing 10 approach a reference temperature. As a result, the heating time T and heating power P required for raising the temperature of the photosensitive material 20 from the present temperature to an optimum temperature for development become substantially equal to $T_0$ and $P_0$, respectively.

Then, the motor 22 is turned ON in Step 102 so as to load the photosensitive material 20 into the casing 10. In Step 104, the air temperature ta inside the casing 10 and the temperature tc of the heat-reflecting plate 34 are read off from the temperature sensor 38 and the temperature sensor 36, respectively. In Step 106, the respective correction values ΔT and ΔP for the present temperatures ta and tc are calculated from the data stored in the ROM 28C, and the time T and the power P are calculated on the basis of the formulae (1) and (2), respectively. Then, in Step 108, the make contact 26 is closed for the time T by energizing the exciting coil L, and the calculated power P is supplied to the electrically conductive, heat-generating layer **20*b* by feedback control. Then, the motor 22 is turned ON in Step 110 so that the photosensitive material 20 is unloaded from the casing 10** and transported to a thermal transfer apparatus (not shown).

Figure 3:
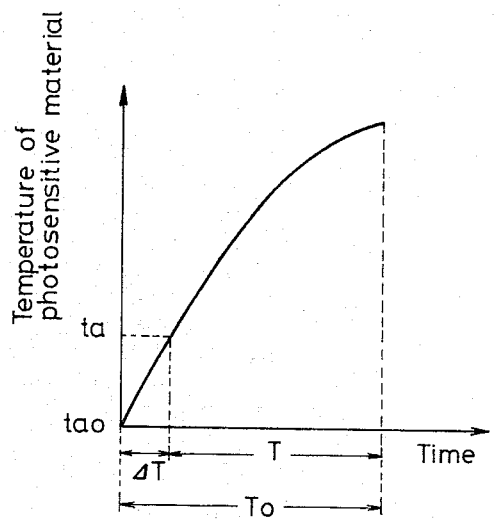
FIG. 3 is a graph showing the relationship between the heating time and the temperature of the photosensitive material in the control effected in accordance with the flow chart shown in FIG. 2.
Figure 4A:
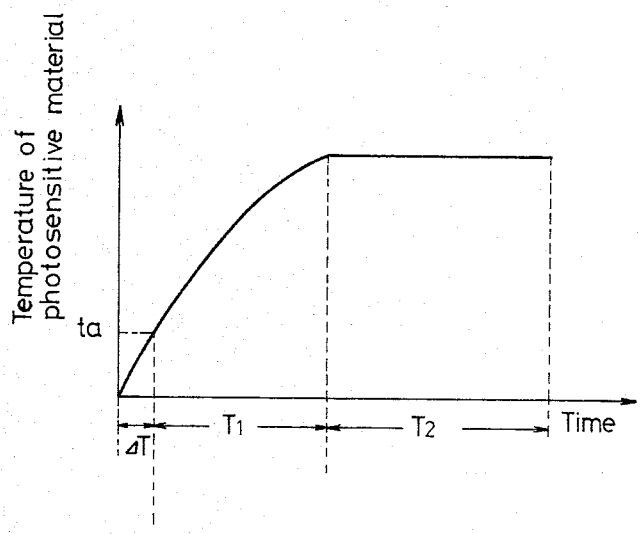
FIG. 4(*a*) is a graph showing the relationship between the heating time and the temperature of the photosensitive material in a second embodiment of the thermal developing apparatus according to the present invention.
Figure 4B:
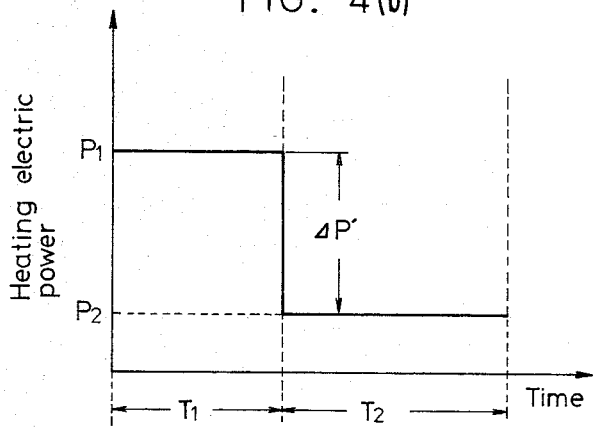

FIG. 3 is a graph showing the relationship between the time and the temperature of the photosensitive material in the above embodiment. As will be understood from the graph, the time required for heating the photosensitive material from the reference ambient air temperature $ta_0$ to the actual ambient air temperature ta is corrected, and the temperature of the photosensitive material is allowed to rise along a substantially constant curve by the correction of the heating power. The supply of electric power is suspended when a temperature at which the photosensitive material is satisfactorily developed is reached.

Although in the above embodiment the supply of electric power is suspended when the temperature of the photosensitive material rises to a temperature at which it is satisfactorily developed, the arrangement may be such that when the temperature of the photosensitive material rises to a predetermined temperature, this temperature is maintained for a predetermined period of time, and while doing so, the photosensitive material is thermally developed. In this case, the heating time $T_1$ and heating power $P_1$ required for raising the temperature of the photosensitive material are obtained in a manner similar to that in the case of the formulae (1), (2), (5) and (6), while the heating time $T_2$ and heating power $P_2$ required for maintaining the predetermined temperature are expressed as follows:

$$T_2 = K$$

$$P_2 = P_1 + \Delta P'$$

$$\Delta P' = f_6(ta) + f_7(tc)$$

Since $f_6(ta) >> f_7(tc)$, $f_7(tc)$ may be ignored.

Although the heating electric power is controlled in the above embodiments, the heating voltage may be controlled to obtain an optimum temperature for development.

Further, although in the above embodiments both the heating power and the heating time are calculated to obtain an electric energy required, it may be obtained by solely calculating either the heating power or the heating time on the assumption that the other is fixed.

What is claimed is:

1. A thermal developing apparatus which thermally develops a thermally developable photosensitive material (20) having an electrically conductive, heat-generating layer (20*b*), comprising:

temperature sensor means (38) for detecting the temperature of air surrounding said photosensitive material;

calculating means (28) for calculating the electric energy required for raising the temperature of said photosensitive material from a temperature corresponding to said air temperature to a predetermined temperature suitable for development; and supply means (24) for supplying said heat-generating layer with an appropriate electric energy on the basis of the result of calculation carried out by said calculating means.

2. A thermal developing apparatus according to claim 1, wherein said calculating means obtains said required electric energy by calculating the heating time required for raising the temperature of said photosensitive material for a temperature corresponding to said air temperature to said predetermined temperature on the assumption that the electric power is fixed.

3. A thermal developing apparatus according to claim 1, wherein the temperature of air surrounding said photosensitive material is detected prior to supplying said heat-generating layer with electric energy, and the electric energy required for raising the temperature of said photosensitive material from a temperature corresponding to said air temperature to a predetermined temperature is calculated by said calculating means prior to supplying said heat-generating layer with electric energy.

4. A thermal developing apparatus which thermally develops a thermally developable photosensitive material having an electrically conductive, heat-generating layer, comprising:

reflecting means for reflecting heat radiated from said photosensitive material;

temperature sensor means for detecting the temperature of said reflecting means;

temperature sensor means for detecting the temperature of air surrounding said photosensitive material;

calculating means for calculating the electric energy required for raising the temperature of said photosensitive material to a predetermined temperature suitable for development on the basis of both the temperature of said reflecting means and said air temperature; and supply means for supplying said heat-generating layer with an appropriate electric energy on the basis of the result of calculation carried out by said calculating means.

5. A thermal developing apparatus according to claim 4, wherein said calculating means obtains said required electric energy by calculating the electric power needed for raising the temperature of said photosensitive material to said predetermined temperature on the basis of both the temperature of said reflecting means and said air temperature on the assumption that the heating time is fixed.

6. A thermal developing apparatus according to claim 4, wherein said calculating means obtains said required electric energy by calculating the heating time required for raising the temperature of said photosensitive material to said predetermined temperature on the basis of both the temperature of said reflecting means and said air temperature on the assumption that the electric power is fixed.

7. A thermal developing apparatus according to claim 4, wherein said calculating means obtains said required electric energy by calculating both the heating time and the electric power needed for raising the temperature of said photosensitive material to said predetermined temperature on the basis of both the temperature of said reflecting means and said air temperature.

8. A thermal developing apparatus according to claim 4, wherein said supply means first supplies said heat-generating layer with said calculated electric energy and then supplies said heat-generating layer with a smaller electric energy than said calculated electric energy so that the temperature of said photosensitive material is maintained at said predetermined temperature.

9. A thermal developing apparatus according to claim 4, wherein said calculating means calculates said required electric energy in consideration of the heat capacity of said photosensitive material.

10. A thermal developing apparatus which thermally develops a thermally developable photosensitive material having an electrically conductive, heat-generating layer, comprising:

a casing having a vent hole;

a transporting device having a plurality of pairs of electrically conductive rollers and press rollers, said electrically conductive rollers being brought into contact with said heat-generating layer, and said transporting device being housed within said casing such that said photosensitive material is clamped between said pairs of electrically conductive rollers and press rollers so as to be transported;

a heat-reflecting plate mounted on an inner wall of said casing so as to oppose said photosensitive material when loaded into said casing by said transporting device;

a fan for ventilating air within said casing;

a power supply for supplying electric energy to said heat-generating layer through said electrically conductive rollers;

a switch disposed between said electrically conductive rollers and said power supply;

a power detector for detecting the electric energy supplied to said heat-generating layer;

a temperature sensor for detecting the temperature of the air within said casing; and a controller which activates said fan for a predetermined period of time before said heat-generating layer is supplied with electric power, calculates electric energy required for raising the temperature of said photosensitive material from a temperature corresponding to said air temperature measured after said fan has been started to a predetermined temperature suitable for development, turns ON said switch for the period of time required for obtaining said calculated electric energy, and controls said power supply so that the electric energy required for obtaining said calculated electric energy is supplied on the basis of the output of said power detector.

11. A thermal developing apparatus according to claim 10, further comprising:

an air flow-settling plate with a honeycomb-type structure disposed between said heat-reflecting plate and said transporting device within said casing.

12. A thermal developing apparatus according to claim 10, further comprising:

a temperature sensor for detecting the temperature of said heat-reflecting plate; and said controller activating said fan for a predetermined period of time before said heat-generating layer is supplied with electric power, calculating the electric energy required for raising the temperature of said photosensitive material to a predetermined temperature suitable for development on the basis of both the temperature of said heat-reflecting plate and said air temperature measured after said fan has been started, turning ON said switch for the period of time required for obtaining said calculated electric energy, and controlling said power supply so that the electric energy required for obtaining said calculated electric energy is supplied on the basis of the output of said power detector.

13. A thermal developing apparatus according to claim 10, further comprising:

a duct connected to a portion of said casing where said fan is mounted; and said temperature sensor for detecting said air temperature being disposed within said duct.

14. A thermal developing apparatus according to claim 10, wherein said controller activates said transporting device after starting said fan so that said photosensitive material is loaded into said casing.

15. A thermal developing apparatus according to claim 10, wherein said controller keeps said switch ON even after the temperature of said photosensitive material has been raised to said predetermined temperature so that said heat-generating layer is supplied with a smaller electric energy than said calculated electric energy, thereby maintaining the temperature of said photosensitive material at said predetermined temperature.

16. A thermal developing apparatus according to claim 10, wherein said controller calculates said required electric energy in consideration of the heat capacity of said photosensitive material.

17. A thermal developing apparatus which thermally develops a thermally developable photosensitive material having an electrically conductive, heat-generating layer, comprising:

temperature sensor means for detecting the temperature of air surrounding said photosensitive material;

calculating means for calculating the electric energy required for raising the temperature of said photosensitive material from a temperature corresponding to said air temperature to a predetermined temperature suitable for development; and supply means for supplying said heat-generating layer with an appropriate electric energy on the basis of the result of calculation carried out by said calculating means. wherein said calculating means obtains said required electric energy by calculating the electric power needed for raising the temperature of said photosensitive material from a temperature corresponding to said air temperature to said predetermined temperature on the assumption that the heating time is fixed.

18. A thermal developing apparatus which thermally develops a thermally developable photosensitive material having an electrically conductive, heat-generating layer, comprising:

temperature sensor means for detecting the temperature of air surrounding said photosensitive material;

calculating means for calculating the electric energy required for raising the temperature of said photosensitive material from a temperature corresponding to said air temperature to a predetermined temperature suitable for development; and supply means for supplying said heat-generating layer with an appropriate electric energy on the bases of the result of calculation carried out by said calculating means. wherein said calculating mean obtains said required electric energy by calculating both the heating time and electric power required for raising the temperature of said photosensitive material from a temperature corresponding to said air temperature to said predetermined temperature.

19. A thermal developing apparatus which thermally develops a thermally developable photosensitive material having an electrically conductive, heat-generating layer, comprising:

temperature sensor means for detecting the temperature of air surrounding said photosensitive material;

calculating means for calculating the electric energy required for raising the temperature of said photosensitive material from a temperature corresponding to said air temperature to a predetermined temperature suitable for development; and supply means for supplying said heat-generating layer with an appropriate electric energy on the basis of the result of calculation carried out by said calculating means, wherein said supply means first supplies said heat-generating layer with said calculated electric energy and then supplies said heat-generating layer with a smaller electric energy than said calculated electric energy so that the temperature of said photosensitive material is maintained at said predetermined temperature.

20. A thermal developing apparatus which thermally develops a thermally developable photosensitive material having an electrically conductive, heat-generating layer, comprising:

temperature sensor means for detecting the temperature of air surrounding said photosensitive material;

calculating means for calculating the electric energy required for raising the temperature of said photosensitive material from a temperature corresponding to said air temperature to a predetermined temperature suitable for development; and supply mean for supplying said heat-generating layer with an appropriate electric energy on the basis of the result of calculation carried out by said calculating means, wherein said calculating means calculates said required electric energy in consideration of the heat capacity of said photosensitive material.

* * * * *